US008262144B2

(12) United States Patent
Lee et al.

(10) Patent No.: US 8,262,144 B2
(45) Date of Patent: Sep. 11, 2012

(54) TWEEZERS

(75) Inventors: Won Bien Lee, Clifton, NJ (US); Ross Exley, Clifton, NJ (US)

(73) Assignee: Dimensions Crafts LLC, Reading, PA (US)

( * ) Notice: Subject to any disclaimer, the term of this patent is extended or adjusted under 35 U.S.C. 154(b) by 0 days.

(21) Appl. No.: 12/781,356

(22) Filed: May 17, 2010

(65) Prior Publication Data

US 2011/0278869 A1 Nov. 17, 2011

(51) Int. Cl.
*B25B 9/02* (2006.01)
*A47F 13/08* (2006.01)
*A47G 21/10* (2006.01)

(52) U.S. Cl. ..... 294/2; 294/3; 294/99.2

(58) Field of Classification Search ..... 294/3, 99.2, 294/2, 16, 33, 99.1; 606/210, 211, 206; 81/3.8, 81/13, 44; 269/6; 7/101, 118; 30/142, 150; D28/55

See application file for complete search history.

(56) References Cited

U.S. PATENT DOCUMENTS

| | | | | | |
|---|---|---|---|---|---|
| 75,453 | A | * | 3/1868 | Patton | 294/3 |
| 254,631 | A | * | 3/1882 | Fisher | 294/99.2 |
| 277,531 | A | * | 5/1883 | Ackermann | 294/3 |
| 400,067 | A | * | 3/1889 | Evans | 294/3 |
| 860,759 | A | * | 7/1907 | Motter | 294/3 |
| 1,033,942 | A | | 7/1912 | Ruggles | |
| 1,176,604 | A | | 3/1916 | Sanders | |
| 1,516,955 | A | | 11/1924 | Cusimano | |
| 1,657,497 | A | | 1/1928 | Cichon | |
| 2,042,891 | A | | 6/1936 | Gailey | |
| 2,579,207 | A | * | 12/1951 | Scheib | 29/766 |
| 2,670,234 | A | * | 2/1954 | Roop | 294/99.2 |
| 2,802,211 | A | | 8/1957 | Friedman | |
| 2,876,778 | A | | 3/1959 | Kees, Jr. | |
| 2,903,078 | A | | 9/1959 | Silenzi et al. | |
| 3,115,360 | A | * | 12/1963 | Witkoff | 294/99.2 |
| 3,291,476 | A | | 12/1966 | Calkin | |
| 3,802,437 | A | | 4/1974 | Kees, Jr. | |
| 3,980,861 | A | | 9/1976 | Fukunaga | |
| 4,635,636 | A | | 1/1987 | Goldstein | |
| D350,465 | S | * | 9/1994 | Walsky | D8/52 |
| 5,793,018 | A | * | 8/1998 | Jett | 219/225 |
| 5,849,017 | A | * | 12/1998 | Reynolds et al. | 606/122 |
| 5,972,021 | A | | 10/1999 | Huttner et al. | |

(Continued)

FOREIGN PATENT DOCUMENTS

JP 03-075053 A 3/1991

(Continued)

OTHER PUBLICATIONS

PCT Invitation to Pay Additional Fees and, Where Applicable Protest Fee, Jan. 31, 2012, 3 pages.

(Continued)

*Primary Examiner* — Paul T Chin
(74) *Attorney, Agent, or Firm* — Foley & Lardner LLP

(57) ABSTRACT

A hand tool includes a main body, a pair of arms connected to the main body, first tips connected to the arms and configured to grasp an object, and second tips connected to the arms and configured to grasp an object. The first tips are connected to the second tips. Another aspect of the invention is directed to a hand tool including a main body, a pair of arms connected to the main body, and a scoop portion at one end of the main body.

11 Claims, 8 Drawing Sheets

U.S. PATENT DOCUMENTS

| | | | | |
|---|---|---|---|---|
| D456,076 | S | 4/2002 | Tyler | |
| 6,471,515 | B2 | 10/2002 | Feuer | |
| 6,916,054 | B1 | 7/2005 | Baldesberger | |
| D521,685 | S * | 5/2006 | Cho | D28/55 |
| D532,553 | S | 11/2006 | Ross | |
| 7,216,910 | B2 | 5/2007 | Frauscher | |
| D559,457 | S | 1/2008 | Garland et al. | |
| D575,904 | S | 8/2008 | Iqbal | |
| 7,531,197 | B2 * | 5/2009 | Jones | 294/3 |
| 2002/0106609 | A1 | 8/2002 | Palermo et al. | |
| 2009/0134645 | A1 | 5/2009 | Dong et al. | |
| 2010/0001541 | A1 | 1/2010 | Sugiyama | |

FOREIGN PATENT DOCUMENTS

| | | | |
|---|---|---|---|
| JP | 2005-124892 | A | 5/2005 |

OTHER PUBLICATIONS

PCT International Search Report dated Apr. 6, 2012, PCT/US2011/035907, 5 pages.

* cited by examiner

GRABS AROUND OUTSIDE

GRABS INSIDE

TWEEZERS

BACKGROUND OF THE INVENTION

1. Field of the Invention

The invention is directed generally to tweezers and, more particularly, to tweezers with multipurpose tips. Moreover, the invention is directed to tweezers having additional functionality including a scoop.

2. Related Art

Typical prior art tweezers have tips used for grasping objects. These tips are typically configured such that they may only be able to grasp using a single aspect of the tips. In that regard, the tips are only usable for a single purpose whether the tips are pointed, rounded or flat. Accordingly, if a user wants to grasp different objects they may have to utilize the single functional tips as they can. Alternatively, the user may have to use a different set of tweezers having different tip shapes in order to grasp different objects or objects in different ways. This results in the tweezers being less useful in that they only have a single purpose and accordingly a user would not be able to fully utilize a set of tweezers for multiple objects or being able to use the tweezers to grasp objects in different ways.

Additionally, typically tweezers do not have additional functionality to provide the ability to scoop and gather small objects. In this regard, a user using tweezers to move and manipulate small objects may have the need to gather such small objects and carry them or transport them to a desired location. This results in a user needing to have an additional device to help gather and hold the small objects. This results in having more devices or alternatively increased costs and a need to exchange one device for another in the typical use of working with objects.

Accordingly, there is a need for tweezers that have multi purpose tips that are useful for grasping different objects or for grasping objects in different ways. Moreover, there is a need for tweezers to have additional functionality in order to scoop, transport, and/or gather small objects.

SUMMARY OF THE INVENTION

The invention meets the foregoing need and provides an apparatus that is able to utilize multipurpose tips in order to grasp different types of objects or objects in different ways, additionally the invention meets the forgoing need and provides and apparatus that includes the ability to scoop and carry small objects, and that furthermore includes other advantages apparent from the discussion herein.

The invention may be implemented in a number of ways. According to one aspect of the invention a hand tool including a main body, a pair of arms connected to the main body, first tips connected to the arms and configured to grasp an object, and second tips connected to the arms and configured to grasp an object, wherein the first tips are connected to the second tips.

Accordingly, in one aspect of the invention a hand tool including a main body, a pair of arms connected to the main body, and a scoop portion at one end of the main body.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and the various ways in which it may be practiced. In the drawings.

DETAILED DESCRIPTION OF THE INVENTION

Figure 1:
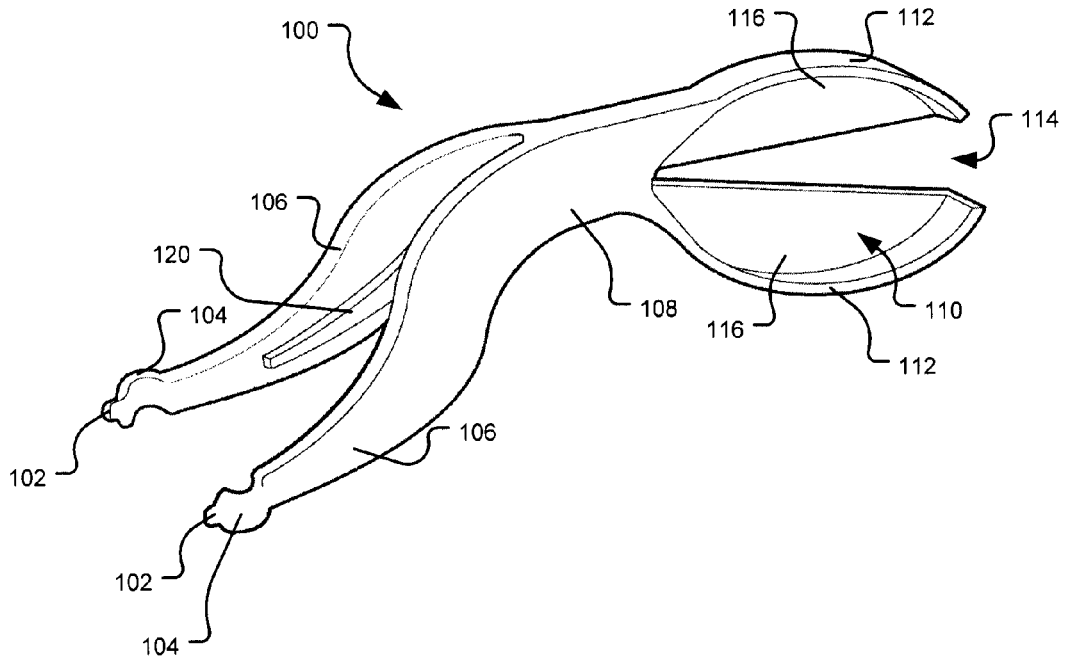
FIG. 1 shows tweezers constructed according to the principles of the invention.

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings.

The invention is directed to a tweezers-like tool that that has one or more purposes: (1) to grab small parts that may or may not be oddly shaped, and (2) to pickup or cleanup small parts quickly and easily by a unique scooping action. The grabbing area or tips may grab small objects that may or may not be rounded and may or may not be unevenly shaped, thus making them difficult to pickup with other tweezers-like tools. The tips have a specially designed shape that incorporate two different areas for grabbing. The shape may be curved in such a way that rounded shapes may be cradled by squeezing them around the rounded edges. The curve of the tips may be shaped to grab on a variety of rounded objects, and are not intended for one particular round size. The curve of the tips may also protrude outward at the end to make a short point. The short point may be used on very small objects or to grab at random surfaces that may or may not be rounded.

The opposite end of the tweezers may also be designed to function as a second working area. That area may be shaped to easily surround and hold one or more objects. Squeezing or pushing the sides of the end together activates the surrounding and holding actions.

FIG. 1 shows tweezers constructed according to the principles of the invention. In particular FIG. 1 shows tweezers 100. The tweezers 100 may include arms 106 that may be connected to a main body 108. The arrangement of the arms 106 with respect to the main body 108 may be such that the arms 106 are in the spread apart extended configuration. This arrangement uses the structural connection between the arms 106 and the main body 108 to create an elastic and deformable arrangement such that when a user holds on to the main body 108 and/or arms 106 the user may then squeeze the arms 106 against the elastic force created by the connection of the arms 106 to the main body 108 to push the tips 102, 104 together in order to grasp an object.

The shape of the arms 106 may be a downward curving shape as shown in FIG. 1. This shape allows a user to extend the tweezers 100 above a working surface and to be able to extend the tweezers 100 down toward the working surface without disturbing the working surface where other objects may be placed.

The arms 106 and main body 108 may include a reinforcing portion 120. This reinforcing portion 120 may increase the strength of the arms 106 and or may further increase the elastic of properties of the arms 106 to urge the arms 106 apart. The reinforcing portion 120 is optional, but may be formed of the same material as the tweezers 100 and accordingly is just a thickening of the area associated with arms 106. Alternatively, the reinforcing portion 120 may be a different material, such as a metallic material, that is embedded or attached to the surface of the arms 106.

Figure 2:
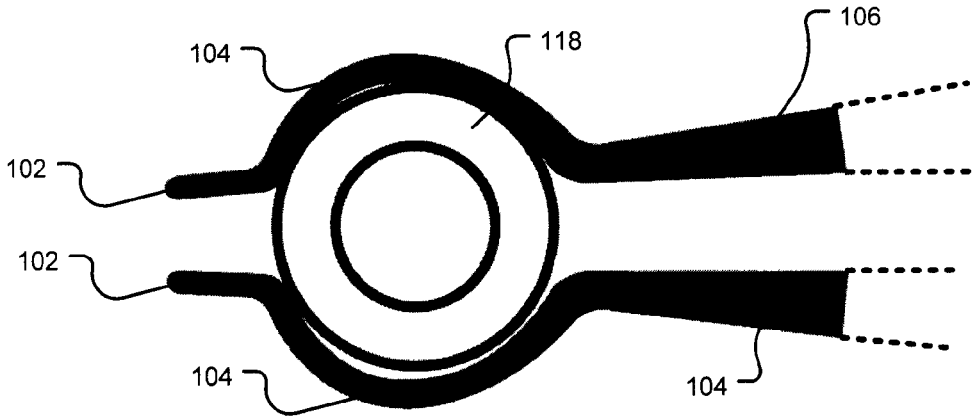
FIG. 2 shows a partial top view of the tweezers of FIG. 1 showing only the tip portions grasping a circular object by its circumferential sides constructed according to the principles of the invention.

At the end of arms 106 are tips 102. The tips 102 may have a circular or a non-blunt construction. This circular or non-blunt construction may be beneficial as the tips 102 will have less of a tendency to injure the users due to their blunt and curved nature. Alternatively, the tips 102 may be pointed in order to better grasp smaller objects. The arms 106 may further include circular tip portions 104. The circular tip portions 104 may be used to grasp objects by their outside surfaces. For example, as shown in FIG. 2, the circular portions 104 may be used to grab around the outside surface of an object such as object 118. As shown in FIG. 1, the circular portion 104 may be directly connected to arms 106, and the tips 102 connected to circular tip portion 104. However, it is noted that other arrangements of the multipurpose aspect of the tips may include other arrangements and configurations. As such, other arrangements and configurations are contemplated by the invention herein.

Figure 3:
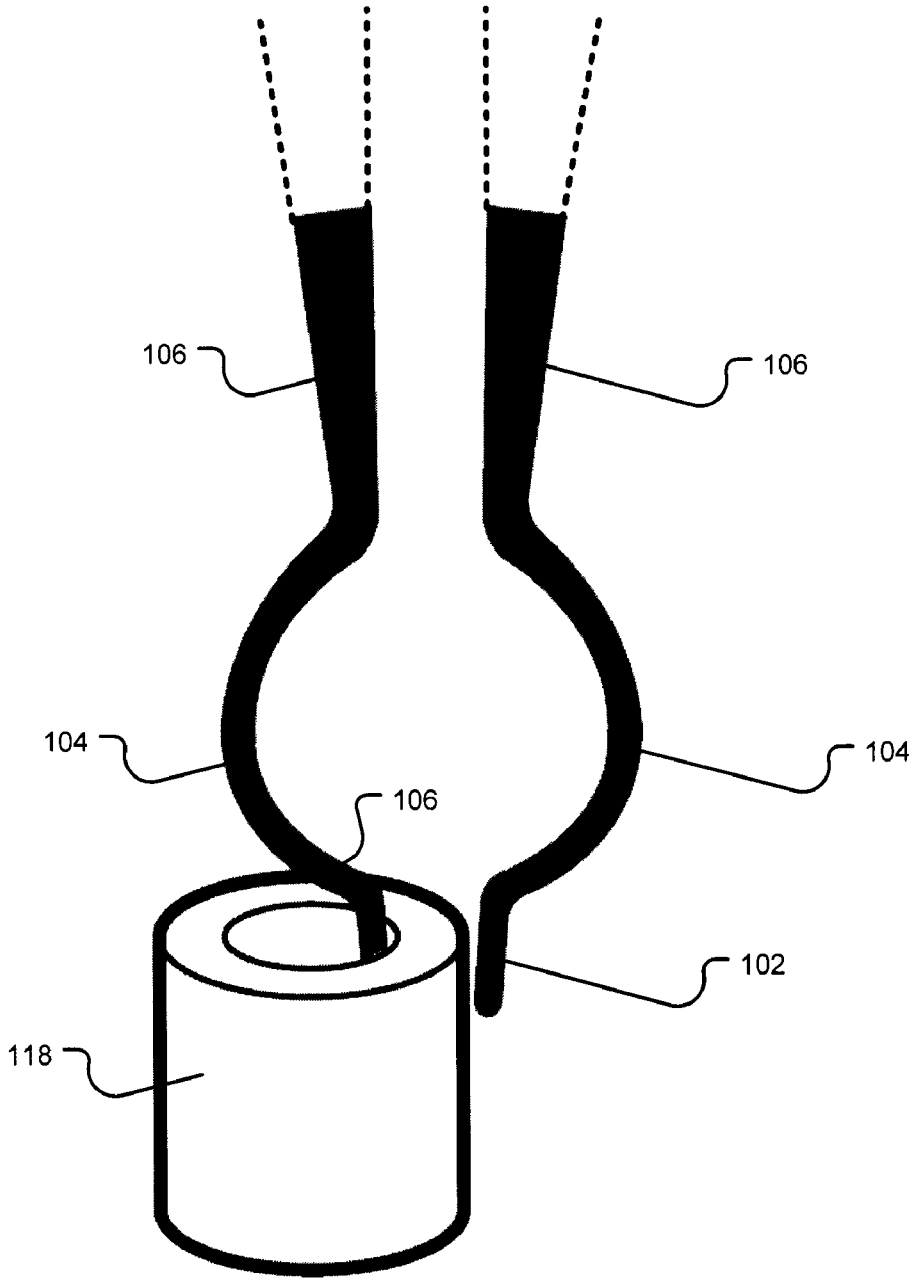
FIG. 3 shows a partial top view of the tweezers' tips of FIG. 1 grasping a circular object by its inside and outside surfaces constructed according to the principles of the invention.

The tips 102 may be used as shown in FIG. 3 to grasp a smaller portion of an object such as object 118. As further shown in FIG. 3, the tips 102 may grasp an outer edge and an inner edge of an object.

Accordingly the multipurpose aspect of the tips 102 and 104 provide the tweezers 100 with the ability to grasp multiple objects of different shapes and sizes or to grab an object in different ways. This provides the tweezers 100 with a greater usability in that the multiple tip portions 102, 104 double the functionality of the tweezers 100. Although particular shapes are shown for tweezers tips 102, 104, other shapes are contemplated by the invention herein. These other shapes may include pointed, flat, square, and the like.

The tweezers 100 may also include a scoop portion 110. It should be noted that the scoop portion 110 may be used with any sort of ordinary type of tweezers or may, as shown in FIG. 1, be used with the tweezers of the invention. The scope portion 110 shown in FIG. 1 is in the open position. The scope 110 may include a scope base 116 that is split to have an upper portion and a lower portion as shown in FIG. 1. The scoop 110 further includes a scoop opening 114 and scoop walls 112. The scoop walls 112 may include an upper wall associated with an upper scoop base 116 and a lower scoop wall 112 associated with a lower scoop base 116. The arrangement of the scoop walls 112 and scoop base 116 may be configured such that it is elastically urged into the open position shown in FIG. 1. This open position provides a scoop opening 114 between the upper scoop walls 112 and lower scoop walls 112 and between the upper scoop base 116 and lower scoop base 116. Accordingly, a user can take the tweezers 100 along with the scoop 110 and lay the tweezers down and urge objects in through the opening 114. The objects may then collect in the scoop opening and on the scoop base 116. The user can then squeeze the upper and lower scoop walls 112 to close the opening between the scoop base 116, 116 and scoop walls 112, 112 to close the scoop opening 114. This squeezing closes the opening 114 and provides a transportation compartment for objects. The user can then deliver these objects to the desired location and invert the scoop or open the scoop opening to allow the objects to be placed in the desired location.

Accordingly, the tweezers 100 of the invention may include multipurpose tips 102, 104 and/or an additional scoop arrangement 110 to provide multiple functionality for the tweezers 100.

Figure 4:
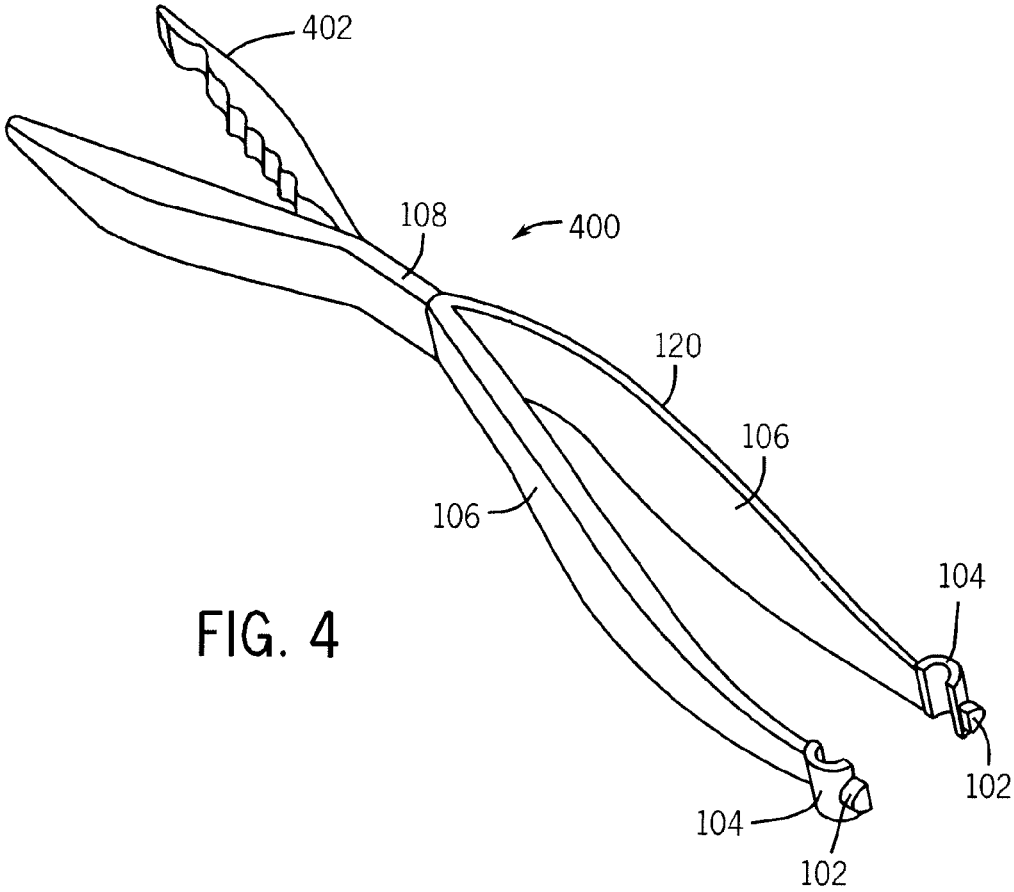
FIG. 4 shows another aspect of tweezers constructed according to the principles of the invention.

FIG. 4 shows another aspect of tweezers constructed according to the principles of the invention. In particular, FIG. 4 includes another aspect of the tweezers shown as tweezers 400. Tweezers 400 include tips 102 having a half cylindrical shape. The cylindrical shape is suited for objects that have rounded internal surfaces. Additionally, tweezers 400 include different shape tip parts 104. The tip parts 104 also are shown as half cylinder shaped portions. These half cylinder shaped portions are also useful in grasping cylindrically shaped objects.

Additionally, the tweezers 400 further may include a different functional portion 402. The functional portion 402 may be used to pickup multiples of oddly shaped parts (like beads). In this regard, function portion 402 may include a serrated portion for picking up objects in the serrations.

Figure 5:
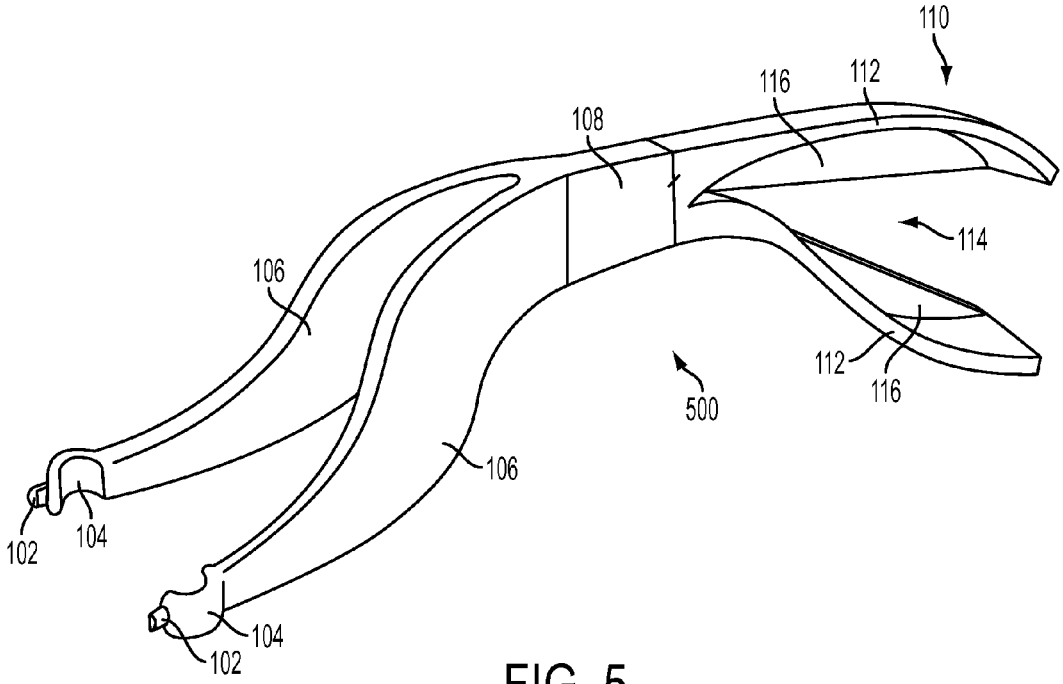
FIG. 5 shows a further aspect of tweezers constructed according to the principles of the invention.

FIG. 5 shows a further aspect of tweezers constructed according to the principles of the invention. In particular, FIG. 5 shows a more narrow scoop portion 110. The scoop portion 110 of tweezers 500 is not as large and cumbersome as the other implementations of the tweezers described herein. Additionally, tweezers 500 include different shaped tips 102, 104 that may be useful in manipulating other types of objects.

Figure 6:
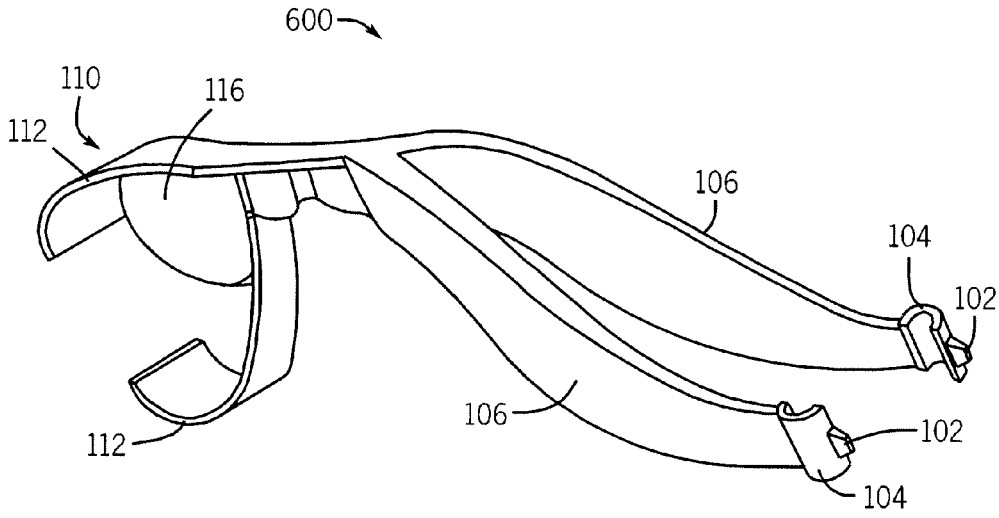
FIG. 6 shows yet another aspect of tweezers constructed according to the principles of the invention.

FIG. 6 shows yet another aspect of tweezers constructed according to the principles of the invention. In particular, tweezers 600 show a scoop 110 having scoop walls 116. More specifically, tweezers 600 and scoop 110 include only a single wall 116 that is movable and only a single base structure 116.

Figure 7:
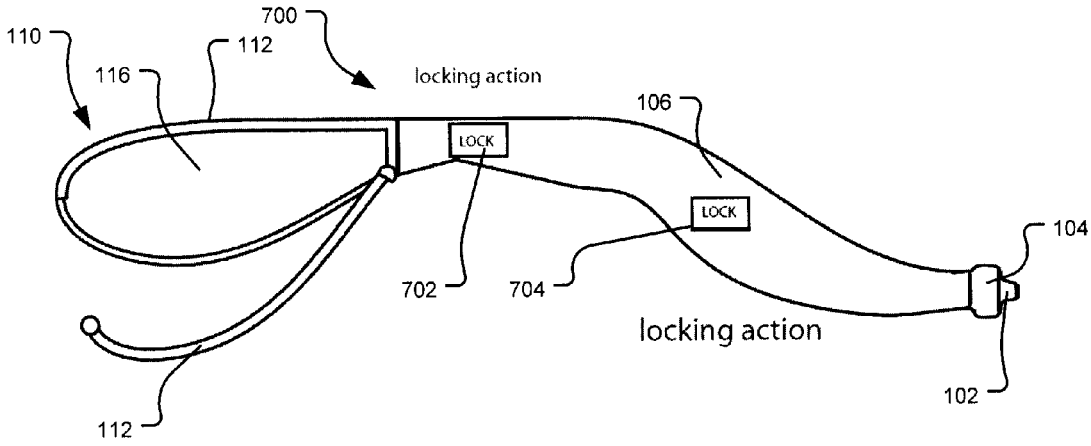
FIG. 7 shows tweezers having a lock constructed according to the principles of the invention.

FIG. 7 shows tweezers having a lock constructed according to the principles of the invention. In particular, FIG. 7 shows tweezers 700 having locks 702, 704. Lock 702 may be configured to lock wall portion 112 with respect to the scoop 110. In particular, wall portion 112 may be pivotally attached to tweezers 700. The lock 702 may then hold the pivotally moving wall 112 with respect to scoop 110 to lock and hold wall 112 in place. In this regard, any of the objects that are held within the scoop 110 may be held by wall 112 and locked in place by actuating lock 702.

Lock 704 may be used to maintain arms 106 in a closed position. Accordingly, when a user is manipulating arms 106 they may operate lock 704 in order to keep arms 106 in the closed position, therefore releasing the need to use their hands to maintain the arms 106 in the closed position.

Figure 8:
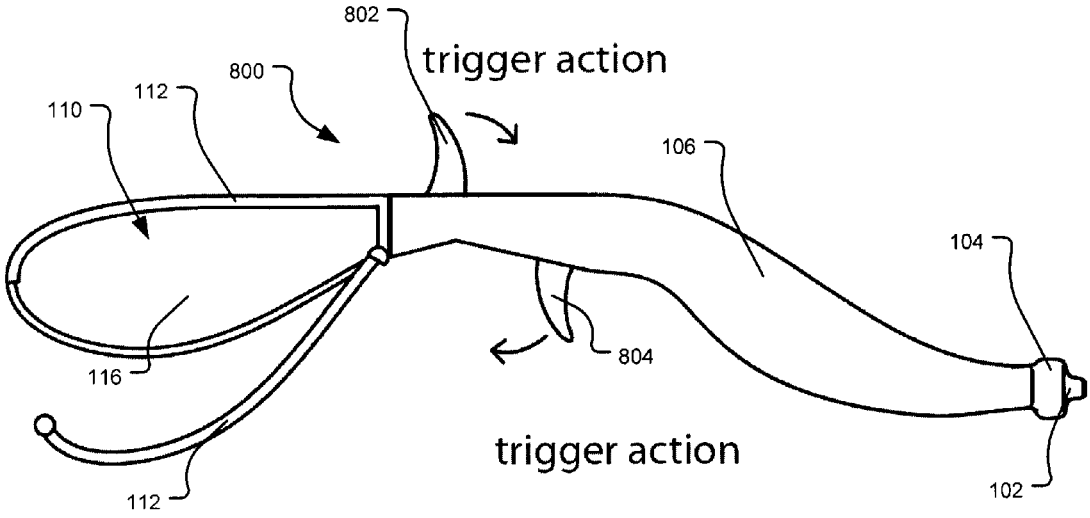
FIG. 8 shows tweezers having a trigger constructed according to the principles of the invention.

FIG. 8 shows tweezers having a trigger constructed according to the principles of the invention. In particular, FIG. 8 shows tweezers 800 which may include operating triggers 802 and 804. In particular, trigger 802 may be used to actuate and move wall portion 112 to close the scoop portion 110. In that regard, trigger 802 may include mechanical structure to link movement of the trigger 802 to movement of the wall structure 110. Accordingly, when a user operates trigger 802 in the direction of the arrow, the wall 112 may pivotally move to close scoop portion 110.

Tweezers 800 further may include the trigger 804 which when manipulated in the direction of the arrow shown in FIG. 8 may move the tweezer arms 106 together. In this regard, the tweezers 800 may include the arms 106 arranged pivotally and link to trigger 804. In this regard, movement of 804 in the backwards arrow direction may pull arms 106 together to grasp an object as described above.

The invention of the tweezers with the multipurpose tips 102, 104 and/or scoop portion 110 is ideally useful for perler beads. Perler beads have a cylindrical shape such as shown by object 118. Furthermore, perler beads are small in size and are difficult to arrange in various patterns that are desired by the user. The use of the tweezers 100 described above allows a user to manipulate such perler beads into the desired arrangements quickly and easily. The invention includes using the tips 102 to grasp perler beads shown in FIG. 3 and also to grasp the outside edges of the perler beads as shown in FIG. 2. Additionally, as perler beads come in great quantities for creating perler designs, the tweezers 100 may also be configured with the scoop 110 to allow a user to scoop up the desired colored beads for use in creating the project and further allow the user to scoop and carry the unused beads back to the bead containers as desired.

Although one aspect of the invention as described above is directed to perler beads, it should be recognized that the attributes of the invention may be useful in other forms of art, other uses including the manufacturing arts, medical arts, and the like. Such other uses are fully contemplated by the invention herein.

Although the specification refers to the invention as tweezers, it should be noted that the concepts described herein have broad applications to all hand tools. For example, pliers, clamps, tongs, forceps, and the like. Accordingly, the concepts of the invention are contemplated for use with any type of hand tool.

While the invention has been described in terms of exemplary embodiments, those skilled in the art will recognize that the invention can be practiced with modifications in the spirit and scope of the appended claims. These examples given above are merely illustrative and are not meant to be an exhaustive list of all possible designs, embodiments, applications or modifications of the invention.

What is claimed:

1. A hand tool comprising: a main body; a pair of arms connected to a first end of the main body; first tips connected to a first end of said arms and extending parallel with a longitudinal axis of said hand tool, and configured to grasp an object; and second tips connected to said arms and said first tips, said second tips disposed between said arms and said first tips and having a first curved portion and a second curved portion and configured to grasp an object.

2. The hand tool according to claim 1 wherein the arms are configured to be elastically urged to separate from one another.

3. The hand tool according to claim 1 wherein the second tips have a semicircular inner surface.

4. The hand tool according to claim 1 wherein said arms have a curved shape extending downwardly from the main body to the first and second tips.

5. The hand tool according to claim 1 further comprising a reinforcing portion on one of said arms or embedded in said arms.

6. The hand tool according to claim 1 wherein the first tips have a blunt circular outward configuration.

7. The hand tool according to claim 1 further comprising a scoop portion at a second end of the main body.

8. The hand tool according to claim 7 wherein the scoop portion further comprises a scoop opening.

9. The hand tool according to claim 7 wherein said scoop portion comprises scoop walls on first and second portions.

10. The hand tool according to claim 7 wherein the scoop portion comprises first and second scoop bases.

11. The hand tool according to claim 7 wherein the scoop portion is configured as two portions and further configured to be squeezed to close a scoop opening, the scope portions moveable relative to each other in a direction perpendicular to a direction that the arms are movable relative to each other.

* * * * *